US005186255A

United States Patent [19]

Corey

[11] Patent Number: 5,186,255

[45] Date of Patent: Feb. 16, 1993

[54] FLOW MONITORING AND CONTROL SYSTEM FOR INJECTION WELLS

[76] Inventor: John C. Corey, 212 Lakeside Dr., Aiken, S.C. 29803

[21] Appl. No.: 730,424

[22] Filed: Jul. 16, 1991

[51] Int. Cl.[5] ..... E21B 34/06; E21B 34/16; E21B 43/12; E21B 47/00

[52] U.S. Cl. ..... 166/250; 73/155; 166/50; 166/53; 166/66; 166/252

[58] Field of Search ..... 166/250, 252, 320, 53, 166/50, 66, 65.1, 332; 73/155

[56] References Cited

U.S. PATENT DOCUMENTS

| | | | |
|---|---|---|---|
| 2,352,834 | 7/1944 | Hassler | 166/252 |
| 2,376,878 | 5/1945 | Lehnhard, Jr. | 73/152 |
| 3,130,784 | 4/1964 | Pennington, II | 166/42 |
| 3,362,477 | 1/1968 | Brandt | 166/42 |
| 3,455,382 | 7/1969 | Chenoweth | 166/147 |
| 3,993,130 | 11/1076 | Papp | 166/330 |
| 4,050,516 | 9/1977 | Canterbury | 166/305 |
| 4,248,302 | 2/1981 | Churchman | 166/272 |
| 4,374,544 | 2/1983 | Westerman et al. | 166/252 |
| 4,655,289 | 4/1987 | Schoeffler | 166/320 |
| 4,691,778 | 9/1987 | Pyne | 166/320 |
| 4,721,158 | 1/1988 | Merritt, Jr. et al. | 166/250 |

*Primary Examiner*—Stephen J. Novosad
*Attorney, Agent, or Firm*—Harold M. Dixon; William R. Moser; Richard E. Constant

[57] ABSTRACT

A system for monitoring and controlling the injection rate of fluid by an injection well of an in-situ remediation system for treating a contaminated groundwater plume. The well is fitted with a gated insert, substantially coaxial with the injection well. A plurality of openings, some or all of which are equipped with fluid flow sensors and gates, are spaced along the insert. The gates and sensors are connected to a surface controller. The insert may extend throughout part of, or substantially the entire length of the injection well. Alternatively, the insert may comprise one or more movable modules which can be positioned wherever desired along the well. The gates are opened part-way at the start of treatment. The sensors monitor and display the flow rate of fluid passing through each opening on a controller. As treatment continues, the gates are opened to increase flow in regions of lesser flow, and closed to decrease flow in regions of greater flow, thereby approximately equalizing the amount of fluid reaching each part of the plume.

14 Claims, 2 Drawing Sheets

FLOW MONITORING AND CONTROL SYSTEM FOR INJECTION WELLS

The United States Government has rights in this invention pursuant to Contract No. DE-AC09-89SR18035 between the U.S. Department of Energy and Westinghouse Savannah River Company.

BACKGROUND OF THE INVENTION

1. Field of the Invention

The present invention relates to a system for monitoring and controlling the rate of fluid flow from an injection well used for in-situ remediation of contaminated groundwater.

2. Discussion of Background

Contaminated soil and groundwater can be treated in a direct manner by excavating contaminated subsurface materials such as soils, sediments, fractured rock, and the like, and by pumping contaminated water to the surface of the earth for treatment. These methods of dealing with contaminated groundwater are relatively expensive.

An indirect method relies on well systems for extraction of contaminated groundwater or for injection of various treatment substances for in-situ stabilization. An injection well for in-situ treatment of contaminated groundwater in a well system, and in particular a horizontal well system, is described in commonly assigned U.S. Pat. No. 4,832,122 issued to Corey, et al. The system disclosed therein by Corey is illustrated in FIG. 1.

As seen in FIG. 1, the subsurface structure under the earth's surface 10 includes an upper, unsaturated or vadose zone, indicated generally at A, and a lower, saturated zone, indicated generally at B. Zones A and B meet at water table 12. Plume 14, which contains contaminants having a preference for the gaseous phase, lies below surface 10. Injection well system 16, situated below plume 14 in saturated zone B, includes vertical shaft 18, horizontal injection well 20, and pump 22. Extraction well system 24, situated above plume 14 in vadose zone A, includes vertical shaft 26, horizontal extraction well 28, and pump 30. Pump 30 is connected to treatment device 40.

Horizontal wells 20 and 28 have spaced multiple apertures 42, such as slots or perforations. Apertures 42 are large and numerous enough to allow fluid to flow freely therethrough, but narrow enough to keep soil particles from blocking the flow. Alternatively, wells 20 and 28 may be surrounded by mesh sleeves (not shown) to prevent blocking of apertures 42 by soil particles but allow the free flow of fluid out of well 20 and into well 28.

As noted above, factors such as the subsurface geology of the area, fluid flow rates, size and shape of the plume, and drilling economics dictate the dimensions, configuration and orientation of the two well systems, as will be apparent to one skilled in the art. Horizontal wells up to several hundred feet long have been used to treat contaminated groundwater.

Fluid 44 is pumped into injection well system 16 by pump 22. Fluid 44 flows through vertical shaft 18 to injection well 20, exits through apertures 42 into saturated zone B, and percolates into plume 14. The volatile contaminants in plume 14 are carried by fluid 44 to extraction well system 24, entering extraction well 28 through apertures 42. Fluid 44, carrying the volatilized contaminants from plume 14, is drawn by pump 30 to treatment device 40 where the contaminants are separated from fluid 44. Purified fluid 44 may be recycled to injection well system 16 or dispersed into the atmosphere.

The system works well in relatively homogeneous soil. The treatment fluid is injected uniformly into the plume and percolates upwards at approximately the same rate along the entire length of the injection well. However, flow is not uniform if the subsurface conditions are not uniform. In areas of varying permeability, rocky soil, subsurface fissures, mixed soil types, etc., the fluid tends to find preferential pathways through the soil. More fluid passes through some regions of the plume and these regions are decontaminated faster than others. While the overall rate of fluid flow into the injection well can be controlled through pumping volume and aperture size and number, the differential rate of flow into the soil along the length of the well is in major part a function of subsurface characteristics beyond the control of the well operator. Treatment must be continued until the entire plume is decontaminated. Therefore, treatment must continue for a longer time, using more materials, and at a greater cost than in areas of uniform subsurface conditions.

Methods are available for controlling overall fluid flow in injection wells. U.S. Pat. Nos. 4,691,778 and 3,993,130 use two concentric cylinders with multiple ports which can be selectively aligned to adjust the size of the openings, thereby controlling the injection profile. An apparatus for consolidating loose sand around an injection well uses pressure-responsive check valves to regulate the injection of predeterminable amounts of consolidation fluid into a plurality of spaced-apart perforations in the well casing (U.S. Pat. No. 3,362,477).

For efficient treatment of a contaminated plume, it would be desirable to monitor the amount of fluid flowing out of the injection well and differentially adjust the flow so that the amounts injected along the length of the well are appropriate for the subsurface conditions, including the soil conditions and the levels of contaminants, to optimize the overall efficiency of the process. Furthermore, it is desirable to change the flow rates over time if the conditions warrant, such as if the water table fluctuates or if the plume spreads. There is, however, no available method for differentially adjusting the flow of fluid through multiple openings in a horizontal injection well system.

SUMMARY OF THE INVENTION

Accordingly to its major aspects and broadly stated, the present invention is an apparatus for controlling the flow rate of a fluid injected by an injection well and, in particular, holding the flow rate to a preselected flow rate. In a well system where there is an injection well having a casing with a plurality of apertures therethrough, the invention comprises sensors that sense the flow rate and produce an output proportional thereto, means in communication with these sensors for comparing the sensed flow rate to the preselected flow rate, the comparing means being responsive to the sensor output and producing a signal proportional to the difference between the sensed and the preselected flow rates, and means for adjusting the flow rate in response to the difference signal. Preferably, the invention is embodied in an insert with a plurality of openings and a plurality of gates covering the openings to limit the passing of the fluid therethrough and thence through the apertures in the casing of the injection well, and ultimately into the subsurface and the plume. The insert extends along at least a portion of the casing and may be movable axially. The comparison means is preferably included in a controller located remote from the sensors, most preferably up on ground level, and ideally receives input on the flow rate through the plume from detectors placed in the subsurface. The controller contains stored information on the characteristics of the subsurface so that it can change the preselected flow rate accordingly.

The gates of the apparatus of the present invention are opened part-way at the start of injection operations. The sensors monitor and the controller receives and preferably displays the flow rate of fluid passing through the openings. As injection continues, the gates are opened slightly, to increase flow along portions of the pipe where the subsurface conditions tend to restrict outflow or where the flow rate needs to be greater because of higher levels of contamination of a moving plume in the vicinity of the well, or closed slightly, to decrease flow.

An important feature of the present invention is the capability, by moving the gates, of adjusting the flow rate from the injection well. The flow rate can be preselected for a given set of subsurface conditions if the site is well characterized and the gates of the insert preset accordingly, or, the flow rate can be changed to meet changing subsurface conditions, such as a migrating plume. Also, the flow rate can vary along the length of the injection well when the concentration of contaminants varies or the subsurface has occasional features that restrict the flow from the injection well such as relatively denser soil types.

Another feature of the present invention is the capability, in the preferred embodiment, of moving the insert, or series of inserts, along the injection well to the locations where flow rate control is needed. This feature provides greater flexibility in remediating contaminated groundwater in different subsurface environments and preventing, in some cases, flow where flow is undesirable or would do little good, such as where a horizontal well passes just under a man-made structure.

Another feature of the present invention is the sensors themselves. The flow rate through the gates will vary as a result of a number of factors and the variation may be different at different portions of the pipe. Some of the factors that affect flow rate may be predictable based on site characterization, however, it is important to have confirmation of these predictions and to have flow rate information where predictions are not possible. Flow rate information coupled with extraction information can assist in estimating the time and resources required for site remediation.

Another feature of the present invention is the gates for controlling the rate of flow through the insert openings. The gates are preferably movable axially to selectively alter the size of the insert openings and thus alter the flow rates therethrough. If the site is well-characterized, the gates can be preset based on predicted flow rate needs and the inserts positioned accordingly in the injection well. Then, by simply pumping the fluid into the injection well, the flow rates from each opening match the needs for that section of the injection well and fluid and time resources are efficiently used.

Yet another feature of the present invention is the controller. The controller operationally connects the sensors and gates to adjust flow in response to flow rate information. In a preferred embodiment, the controller also receives information from other monitoring sources such as sensors in the plume, in the extraction well, or in other monitoring wells, and preprogrammed information such as site characteristic data and space-time site modeling is combined with sensor data to adjust the flow rates over time. Since plumes are not often static but may spread or drift, the capability of adjusting flow rates over time based on feedback to a site model is an important advantage of the present invention.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
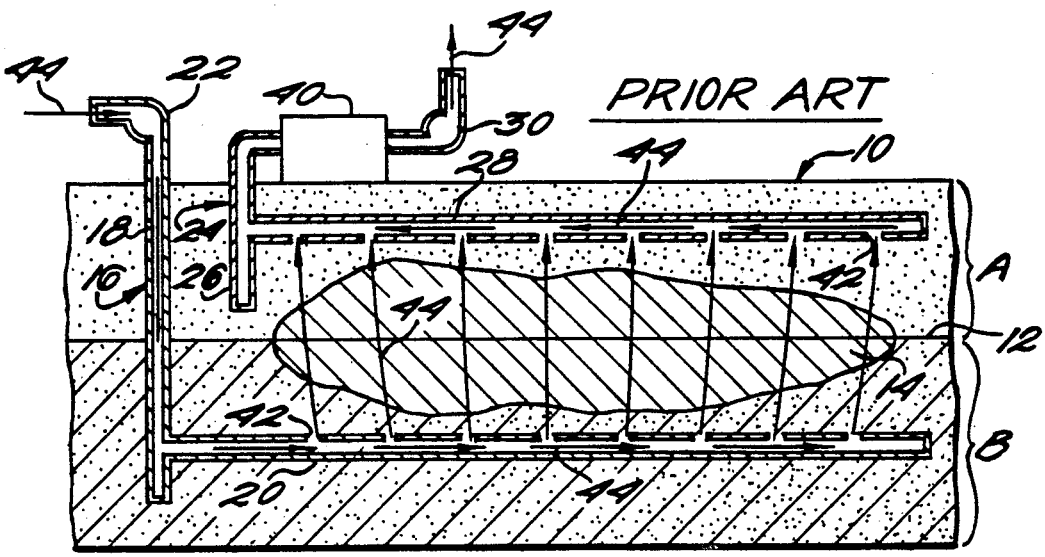
FIG. 1 is a cross-sectional view of a remediation system showing horizontal injection and extraction well systems.
Figure 2:
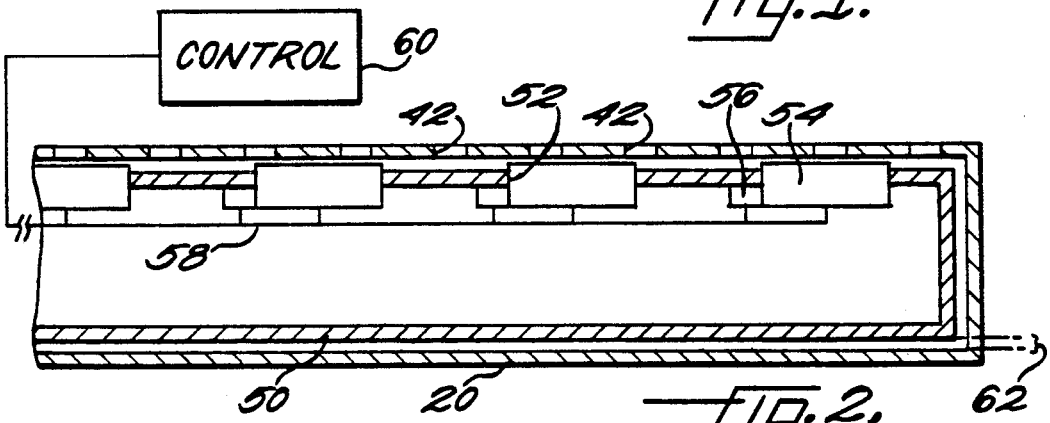
FIG. 2 is a cross-sectional view of a gated insert according to a preferred embodiment of the present invention.

Referring now to FIG. 2, there is shown in cross-section an apparatus for monitoring and controlling the injection rate of fluid according to a preferred embodiment of the present invention. Horizontal injection well 20 of injection well system 16 is fitted with gated insert 50. Spaced along insert 50 are a plurality of openings 52. Some or all of the openings 52 are equipped with a gate 54 and a sensor 56, as may be convenient. Cable 58 connects gates 54 and sensors 56 to surface controller 60 by any convenient mechanical, optical, or electrical linkages. Insert 50 is substantially coaxial with well 20, spaced at a radial distance 62 therefrom. Spacing 62 is such as to allow free flow of fluid 44 through openings 52 and 42, and not to interfere with the operation of gates 54 and sensors 56.

Figure 3A:
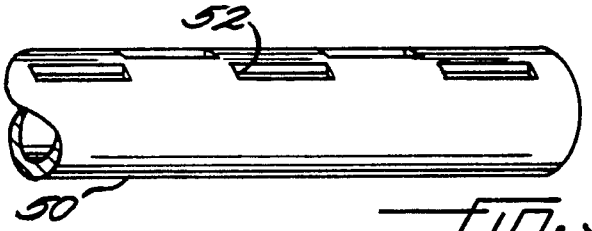
FIG. 3*a* is a perspective view of the surface of a gated insert according to a preferred embodiment of the present invention.
Figure 3B:
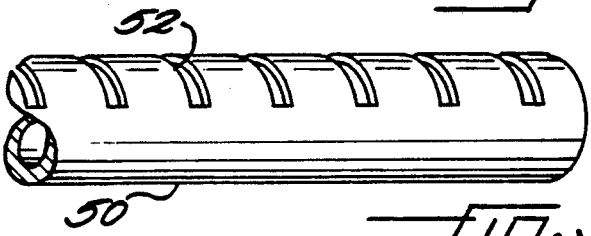
FIG. 3*b* is a perspective view of the surface of a gated insert according to an alternative embodiment of the present invention.

As shown in FIGS. 3*a* and 3*b*, openings 52 may be longitudinal, radial, or some other shape. The size and spacing of openings 52 are determined by the size of system 16, type of fluid 44, the rate at which fluid 44 is injected into system 16 by pump 22, the nature of the contaminants in plume 14, and such other factors as will be apparent in each particular application.

Gates 54 control the size of openings 52. Any appropriate hinged, sliding, or radial-acting closure may be used. If convenient, gates 54 and sensors 56 may be combined in a single unit which both monitors fluid flow and controls the size of openings 52.

For example, gates 54 may be constant flow regulators which maintain flow at a constant rate regardless of pressure fluctuations. Alternatively, gates 54 may be a familiar type of check valve with a spring-loaded valve stem whose position relative to a valve seat depends on the pressure differential between the inside and outside of insert 50. When the pressure of the liquid or gas inside insert 50 is greater than the outside pressure plus the force of the spring, the valve is open and fluid can flow out of the opening. As the outside pressure increases, the valve closes so less fluid can exit the opening.

If convenient, gates 54 may be closed by inflatable obstructions. Means for inflating the obstructions can be connected directly to sensors 56 so that a pressure drop greater than a preselected amount acts to inflate the obstructions. For example, gates 54 may be in the form of diaphragms that close openings 52 in response to the flow rate. By an appropriate choice of diaphragm material and curvature, flow of the fluid through openings 52 over the curved diaphragm will produce a lift or inflation that blocks an opening 52.

Gates 54 may be powered by small, readily-available servo systems linked to sensors 56 and controller 60 by electronic or electro-optical elements, controlled by digital logic techniques. Signals sent by controller 60 and a sensor 56 are compared using digital logic, producing an output if the flow rate through associated opening 52 is too great. The output is combined, again using digital logic, with a second signal from a power source to close gate 54. The controller can establish the preselected flow rates for each gate and change them over time.

Sensors 56 monitor the flow of fluid 44 through openings 52. Fluid 44 is a liquid or a gas, as may be appropriate for the particular application. Preferably, sensors 56 are any convenient pressure or fluid flow sensors which produce an output signal proportional to the injection rate of fluid 44 through openings 52. Alternatively, sensors 56 may produce an output signal proportional to the total amount of fluid 44 which has passed though openings 52. Sensors 56 might, for example, be in the form of very small bore tubes transverse to openings 52, that measure flow rate as a result of pressure drops caused by the flow through openings 52.

Additional pressure or flow sensors (not shown) may be placed in extraction well 28 above plume 14, preferably in 1:1 correspondence with sensors 56 of injection well system 16. The operator can use this data on the flow of contaminant-laden fluid into extraction well 28 for better overall regulation of the system.

Controller 60 displays the injection rate of fluid 44 through openings 52 by any convenient analog or digital means. Gates 54 may be controlled individually, for small-scale adjustments in flow, or in groups for larger-scale adjustments. Preferably, controller 60 allows the operator to make small-scale or large-scale adjustments as desired. The injection rate can be regulated automatically to remain above a preselected lower limit, below an upper limit, within preselected upper and lower limits, or approximately constant. Alternatively, adjustments may be made manually.

Preferably, controller 60 also receives information from other monitoring sources such as sensors in extraction well 28 and other monitoring wells in the area, and preprogrammed information such as site characteristic data and space-time site modeling. Controller 60 can differentially adjust the flow through gates 54 so that the amounts injected along the length of injection well 20 are appropriate for the subsurface conditions, including the soil conditions and the levels of contaminants, to optimize the overall efficiency of the treatment process. Controller 60 can, if desired, change the flow rate through gates 54 at pipe sections where the concentration of the contaminants in plume 14 changes as a result of the movement of groundwater.

Insert 50 may extend throughout substantially the entire length of horizontal injection well 20, or just that part of well 20 which underlies an area of nonuniform soil, as determined by pretreatment testing. If convenient, insert 50 may comprise one or more movable modules which can be positioned wherever needed along well 20.

Horizontal well 20 and insert 50 may be designed so that an appropriately-sized pipe crawler can access the system. A pipe crawler with a video transmitter and one or more remotely-controlled manipulators could, for example, be used to inspect the system, perform routine maintenance and minor repairs, and such other tasks as may be apparent. If convenient, a sensor mounted on the pipe crawler can provide data on fluid flow through openings 52, and a manipulator activated to open or close gates 54 accordingly.

Figure 4A:
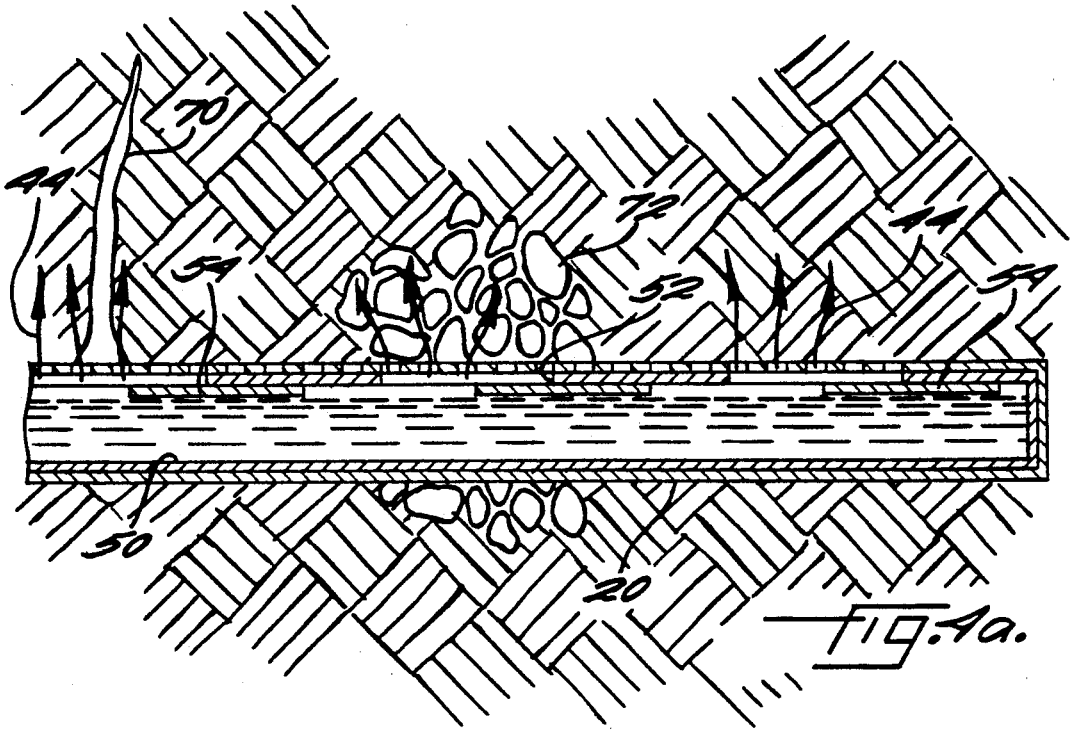
FIG. 4*a* is a cross-sectional view of a gated insert according to a preferred embodiment of the present invention, before fluid flow is adjusted.
Figure 4B:
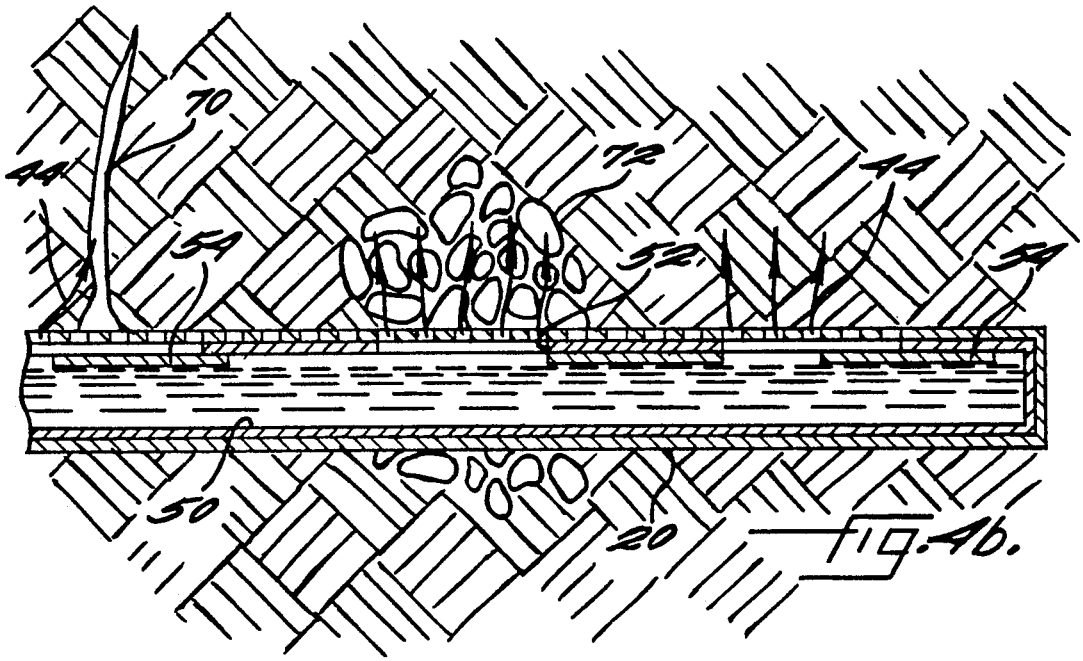
FIG. 4*b* is a cross-sectional view of a gated insert according to a preferred embodiment of the present invention, after fluid flow is adjusted.

In use, gates 54 are opened part-way at the start of treatment. Sensors 56 monitor and display the injection rate of fluid 44 passing through each opening 52 on controller 60. As treatment continues, the operator monitors the flow rates displayed on controller 60. As seen in FIG. 4*a*, flow of fluid 44 is greater near fissure 70 and less near rocky area 72. Treatment of plume 14 can be optimized by opening some gates 54 wider to increase flow in regions of lesser flow, and closing some gates 54 slightly to decrease flow in regions of greater flow, thereby approximately equalizing the amount of fluid 44 reaching each part of plume 14 (FIG. 4*b*).

This system may be readily added to an injection well system wherever pretreatment testing indicates the presence of sufficiently nonuniform subsurface conditions. If desired, it may be incorporated into the system without prior site characterization and used as indicated by flow rate data.

It will be apparent to those skilled in the art that many changes and substitutions can be made to the preferred embodiment herein described without departing from the spirit and scope of the present invention as defined by the appended claims.

What is claimed is:

1. Apparatus for controlling flow rate of a fluid from an injection well, said injection well having a plurality of apertures through which said fluid can be injected into a subsurface, said flow rate to be held to a preselected value, said apparatus comprising:

means for sensing said flow rate, said sensing means producing an output;

means in communication with said sensing means for comparing said flow rate to said preselected value, said comparing means responsive to said output and producing a difference signal; and means for adjusting said flow rate in response to said difference signal, said adjusting means adjusting said flow rate by limiting passage of said fluid through said apertures.

2. The apparatus as recited in claim 1, wherein said limiting means further comprises a generally coaxial insert positioned in spaced relation to said well, said insert having a plurality of openings whereby fluid flows from said insert, thence through said apertures, each opening having a gate that opens and closes in response to and in proportion to said difference signal.

3. The apparatus as recited in claim 1, wherein said comparing means further comprises a controller, said controller located remote from said sensing means and said adjusting means.

4. The apparatus as recited in claim 3, wherein said controller further comprises means for changing said preselected value.

5. An injection well system for injecting a fluid into a subsurface at a flow rate about a preselected flow rate, comprising:

an injection well having a casing with a first plurality of openings therethrough;

an insert within said casing, extending at least a portion of the length thereof and substantially coaxial therewith, said insert having a second plurality of openings therethrough;

sensing means carried by said insert for sensing the flow of said fluid through said second plurality of openings, said sensing means producing an output proportional to said flow rate;

means for comparing said flow rate to said preselected flow rate and producing a difference signal, said comparing means in communication with said output; and means in spaced relation to said second plurality of openings for adjusting the rate of flow through said second plurality of openings in response to said difference signal.

6. The well system as recited in claim 5, wherein said comparing means is a controller and wherein said controller further comprises means for changing said preselected flow rate for a portion of said second plurality of openings.

7. The well system as recited in claim 5, wherein said comparing means is a controller located remotely with respect to said sensing means.

8. The well system as recited in claim 5, further comprising:

a plurality of detectors to be spaced apart from said casing, said detectors measuring the presence of said fluid from said injection well in said subsurface, each of said sensors producing a measurement; and controller means for controlling said comparing means, said controller receiving said measurements from said detectors.

9. The well system as recited in claim 8, wherein said controller stores data characteristic of said subsurface, said controller adapted for changing said preselected flow rate along at least a portion of said injection well in response to said measurements and said subsurface data.

10. The apparatus as recited in claim 5, wherein said adjusting means further comprise a plurality of gates for closing and opening said plurality of openings.

11. The apparatus as recited in claim 10, further comprising means for moving said gates longitudinally back and forth across said openings to adjust said fluid flow rate.

12. The apparatus as recited in claim 5, further comprising means for moving said insert axially within said casing.

13. A method for injecting a fluid into the subsurface through apertures in an injection well, said fluid selected to interact with contaminants in the form of a subsurface plume having various concentrations of contaminants, said plume being likely to move through said subsurface with respect to said well, said method comprising the steps of:

selecting a desired flow rate;

injecting said fluid into said subsurface through said apertures;

sensing the flow rate of said fluid into said subsurface;

adjusting said flow rate so that it matches said desired flow rate; and changing said preselected flow rate to in response to a change in the concentration of said contaminants nearest said well.

14. The method as recited in claim 13, wherein said injection well has an insert along at least a portion of said well, said insert having openings for said fluid to pass therethrough and gates for changing the size of said openings, wherein and adjusting step further comprises the step of changing said size of said openings until said flow rate matches said desired flow rate.

* * * * *